US006345574B1

(12) United States Patent
Charette et al.

(10) Patent No.: US 6,345,574 B1
(45) Date of Patent: Feb. 12, 2002

(54) PRINTING UNIT ARRANGEMENT IN A WEB-FED ROTARY PRINTING PRESS

(75) Inventors: William Albert Charette, Rollinsford, NH (US); Mark Bernard Dumais, Kennebunk, ME (US); Michael Robert Lemelin, Dover; Jackson Hacker Jones, Rochester, both of NH (US)

(73) Assignee: Heidelberger, Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/572,174

(22) Filed: May 17, 2000

(51) Int. Cl.[7] ..... B41F 5/16
(52) U.S. Cl. ..... 101/180; 101/221; 101/247
(58) Field of Search ..... 101/142, 216, 101/217, 218, 219, 220, 221, 222, 223, 247, 248, 249, 177, 179, 180

(56) References Cited

U.S. PATENT DOCUMENTS 5,771,804 A * 6/1998 Knauer et al. ..... 101/183
5,950,538 A * 9/1999 Puschnerat ..... 101/217
5,979,317 A * 11/1999 Singler ..... 101/219
5,988,063 A * 11/1999 Brandenburg et al. ..... 101/219
6,019,039 A * 2/2000 Knauer et al. ..... 101/218
6,032,579 A 3/2000 Richards ..... 101/219
6,050,185 A * 4/2000 Richards ..... 101/142

* cited by examiner

*Primary Examiner*—Ren Yan
(74) *Attorney, Agent, or Firm*—Davidson, Davidson & Kappel, LLC

(57) ABSTRACT

A printing unit arrangement in a web-fed rotary printing press includes at least one printing unit 2*a* having a first and second plate cylinder 4, 6 and associated first and second blanket cylinders 8, 10 which are mechanically coupled via meshing gear wheels and which are commonly driven by one drive motor 12. A second printing unit of the printing unit arrangement includes a first and second plate cylinder 24, 26 and associated first and second blanket cylinders 28, 30. The first plate cylinder 24 and the first and second blanket cylinders 28, 30 are mechanically coupled via meshing gear wheels and are commonly driven by a first drive motor 42. The second plate cylinder 26 is individually driven by a second drive motor 46, and is engageable and disengageable from the associated second blanket cylinder 30 while the printing press is in operation, in order to perform flying edition changes or changes of a spot color.

7 Claims, 4 Drawing Sheets

PRINTING UNIT ARRANGEMENT IN A WEB-FED ROTARY PRINTING PRESS

BACKGROUND OF THE INVENTION

1. Field of the Invention

The present invention relates to a printing unit arrangement in a web-fed rotary printing press. In particular, the present invention relates to a printing unit arrangement in a lithographic web-fed rotary printing press which allows to print a 4/4 image on both sides of a paper web and which also allows for edition changes while the printing press is in operation.

2. State of the Art

In a lithographic web-fed rotary printing press, a running paper web is usually fed through a plurality of blanket-to-blanket printing units, which apply a multicolor image to both sides of the web. For driving the printing units, different drive systems, drive principles and configurations of drive motors and drive gears are known from the prior art.

One of the most common driving principles used in combination with blanket-to-blanket printing units uses one single drive motor per printing unit, in order to drive the couples of associated plate and blanket cylinders which are mechanically coupled via meshing drive gear wheels. Although this principle is the most cost effective principle, the coupling of the plate and blanket cylinders via meshing gear wheels does not allow for flying imprinter operations which are necessary for edition changes and changes of spot colors in the printed image, while the printing press is in operation. Accordingly, these printing units do not offer a high flexibility and also require a shutdown of the printing presses for a comparatively long time, in order to exchange printing plates and/or the printing units in case of an edition change.

U.S. Pat. No. 6,032,579 describes a blanket-to-blanket printing unit for a lithographic web-fed rotary newspaper printing press, in which the two blanket cylinders are mechanically coupled via drive gears which are driven by a first drive motor. Each of the two plate cylinders associated with one of the blanket cylinders is driven by its own independent drive motor, respectively. Due to the simultaneous control of the three independent drive motors, this highly flexible printing unit requires a sophisticated and therefore costly and complex control system.

EP 0 820 861 A2 purports to disclose a blanket-to-blanket printing unit, in which the two blanket cylinders and one of the plate cylinders can be mechanically coupled to each other to be driven by a first drive motor, whereas the second plate cylinder is separately driven by a second drive motor, in order to perform a flying imprinter operation on one side of the web. In order to perform a flying imprinter operation on the other side of the web the drive gear wheel associated with the first drive motor can be brought out of mesh with the gear wheels of the blanket cylinders, and a further gear wheel coupled to the drive shaft of the second drive motor can be brought into mesh with the blanket cylinder drive gear wheels.

Due to the movable drive gear wheels, the print quality which can be obtained with the above-described printing unit is rather low compared to printing units, in which the drive gear wheels of the printing unit cylinders are in a constant mesh. Moreover, the document does not give any teaching to use the described 2-motor-drive printing unit in combination with other printing units in a tower arrangement.

OBJECT OF THE INVENTION

Having outlined the state of the art and its attendant disadvantages, it is accordingly an object of the present invention, to provide for a printing unit arrangement in a lithographic web-fed rotary printing press for printing newspapers, which on the one hand allows for flying imprinter operations, and which on the other hand requires a reduced number of drive motors for driving the printing unit arrangement.

According to a first object of the present invention, a printing unit arrangement in a web-fed rotary printing press comprises a first printing unit including a first and a second plate cylinder and a first and a second blanket cylinder. The first and second blanket cylinders and first and second plate cylinders are mechanically coupled to each other and are commonly driven by a common drive motor. The arrangement further comprises a second printing unit which includes a first plate cylinder, a first blanket cylinder associated with the first plate cylinder, a second blanket cylinder mechanically coupled to the first blanket cylinder and a second plate cylinder associated with and being mechanically coupled to the second blanket cylinder, a first drive motor for individually driving the first plate cylinder and a second drive motor for commonly driving the first and second blanket cylinders and the second plate cylinder. The first and second printing units are arranged to print a colored image on both sides of a running paper web. This embodiment of the invention has the advantage that the second printing unit for performing the flying imprinter operation only uses two drive motors, which require a simplified and much more cost effective control equipment, whereas it allows at the same time for high quality printing, due to the fixed mechanical coupling of the two blanket cylinders and the associated plate cylinder.

According to another object of the present invention, a print unit arrangement in a web-fed rotary printing press comprises a third printing unit, which includes a first plate cylinder, a first blanket cylinder associated with said first plate cylinder, a second blanket cylinder mechanically coupled to said first blanket cylinder and a second plate cylinder associated with and being mechanically coupled to said second blanket cylinder, a first drive motor for individually driving said first plate cylinder and a second drive motor for commonly driving said first and second blanket cylinders and said second plate cylinder. The first plate cylinder of the second printing unit and the first plate cylinder of the third printing unit are engageable and disengageable with their associated blanket cylinders in alternation, in order to perform a flying imprinter operation on the same side of the web.

According to an even further object of the present invention, the printing unit arrangement in a web-fed rotary printing press comprises a first printing unit, which includes a first and a second plate cylinder and a first and a second blanket cylinder. The first and second blanket cylinders and first and second plate cylinders are mechanically coupled to each other and are commonly driven by a common drive motor. Moreover, the arrangement comprises a second printing unit, including a first plate cylinder, a first blanket cylinder associated with the first plate cylinder, a second plate cylinder, a second blanket cylinder associated with the second plate cylinder, the second blanket cylinder being mechanically coupled to said first blanket cylinder, a first drive motor for individually driving the first plate cylinder, a second drive motor for individually driving the second plate cylinder and a third drive motor for driving said first and second blanket cylinders, wherein the first and second printing units are printing a colored image on both sides of a running paper web. Although this embodiment of a printing unit arrangement according to the present invention involves a more sophisticated control system for controlling the three motors of the second printing unit compared to the one described herein before, it, at the same time, provides for a much higher flexibility with respect to the pagination of a print job which is run on the printing press, because the possibility of a flying imprinter operation on both sides of the running paper web does not require a pre-selection and cumulation of specific pages of print jobs which are associated with the flying imprinter operation in the pre-press stage.

According to an exemplary embodiment of the invention, the print unit arrangement further comprises a third printing unit, the third printing unit including a first plate cylinder, a first blanket cylinder associated with the first plate cylinder, a second plate cylinder, a second blanket cylinder associated with the second plate cylinder, the second blanket cylinder being mechanically coupled to the first blanket cylinder, a first drive motor for individually driving the first plate cylinder, a second drive motor for individually driving the second plate cylinder and a third drive motor for driving the first and second blanket cylinders.

BRIEF DESCRIPTION OF THE DRAWINGS

The present invention together with additional objects and advantages thereof will be best understood from the following description of specific exemplary embodiments when read in connection with the accompanying drawings, in which.

SUMMARY OF THE INVENTION

Figure 1:
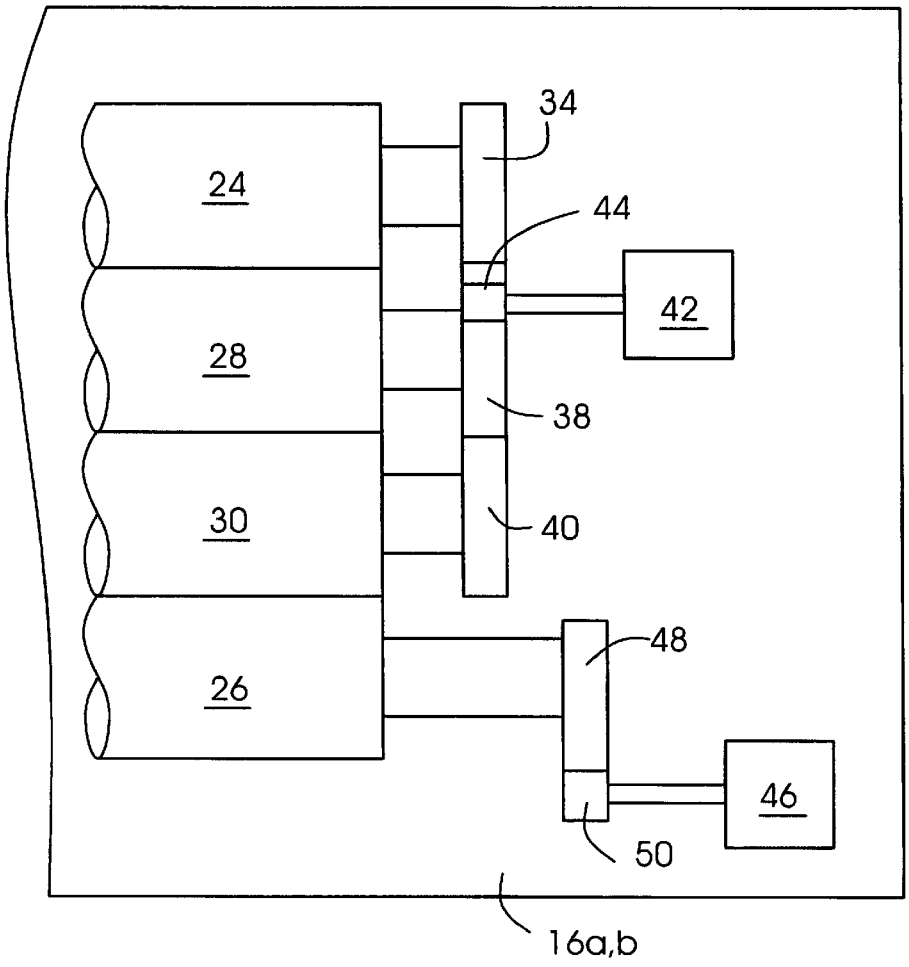
FIG. 1 is a schematic top view of a printing unit according to the present invention.
Figure 2:
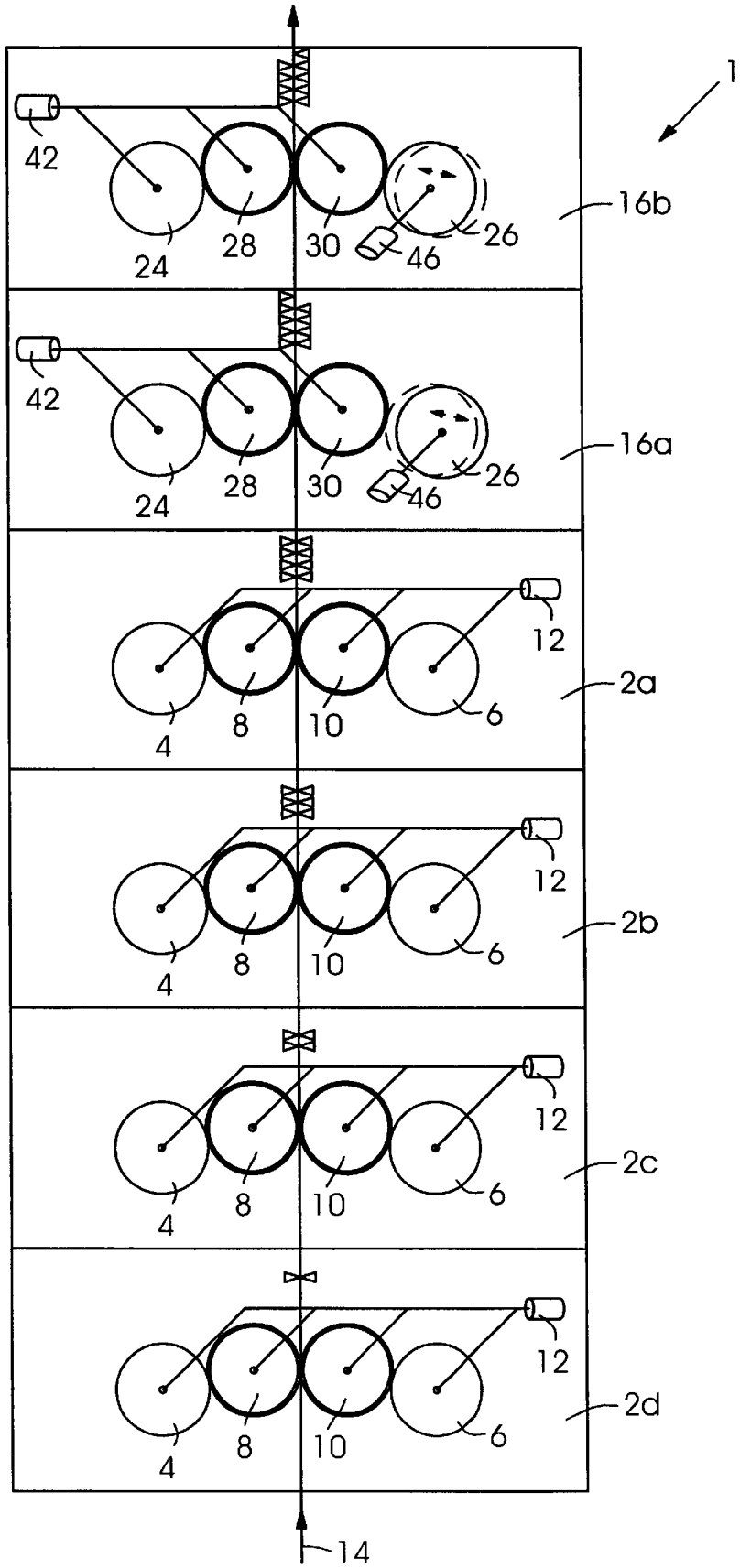
FIG. 2 is a schematic side view of a first embodiment of a printing unit arrangement according to the present invention, in which the flying imprinter operation is performed by means of two printing units in which three of the cylinders are mechanically coupled and are commonly driven by one drive motor and one of the plate cylinders is separately driven by a second drive motor.

As it is shown in FIGS. 1 and 2, a printing unit arrangement 1, which is preferably arranged in form of a tower of printing units, but may also be arranged in a horizontal orientation, comprises at least one first printing unit 2*a*, having a first and second plate cylinder 4, 6 and a first and a second blanket cylinder 8, 10, which are associated with the first and the second plate cylinder 4, 6, respectively.

As it can further be seen from FIG. 2 all cylinders of the printing unit 2*a* are mechanically coupled via meshing gear wheels and are commonly driven by one drive motor 12, in order to print a colored image on both sides of a running paper web 14 which is passing through the nip formed between the two blanket cylinders 8, 10 of the printing unit 2*a*. As it is further indicated in FIG. 2, each printing unit arrangement includes preferably four identical printing units 2*a*, 2*b*, 2*c*, 2*d* of the afore-mentioned type, which are located on top of each other, in order to print a multicolor image, preferably a 4/4-image onto both sides of the web 14.

As it can be seen from FIG. 1 and FIG. 2, the printing unit arrangement 1 of the present invention further comprises a second printing unit 16*a* which includes a first and a second plate cylinder 24, 26 and a first and a second blanket cylinder 28, 30. The first plate cylinder 24 and the first and the second blanket cylinders 28, 30 are mechanically coupled via meshing gear wheels 34, 38 and 40, and are commonly driven by a first drive motor 42 via a drive gear wheel 44. The second printing unit 16*a* further includes a second drive motor 46, which individually drives the second blanket cylinder 26 via meshing gear wheels 48 and 50.

As it is indicated by the dashed lines in FIG. 2, the second plate cylinder 26 can be engaged and disengaged with the associated second blanket cylinder 30, in order to perform a flying imprinter operation of the second printing unit 16*a*.

As it is further shown in FIG. 2 a third printing unit 16*b*, which is preferably of the same type as the second printing unit 16*a*, is located on top of the second printing unit 16*a*. As it is indicated by the dashed lines and by the full lines of the second plate cylinder 26 of the printing unit 16*a* and 16*b*, the second plate cylinders 26 are engaged and disengaged with their associated blanket cylinders 30 in alternation, while the web 14 is passing through the nip formed between the first and second blanket cylinders 28 and 30 of each unit 16*a*, 16*b*, in order to perform a flying imprinter operation in which two different images are printed onto the right side of the web 14 shown in FIG. 2.

The afore-described design has the advantage that only eight motors 12, 42 and 26 are needed to provide for a 4/4-print job with a flying edition change or a flying change of a spot color to be printed as a fifth color to the right side of the web 14 in FIG. 2.

Figure 3:
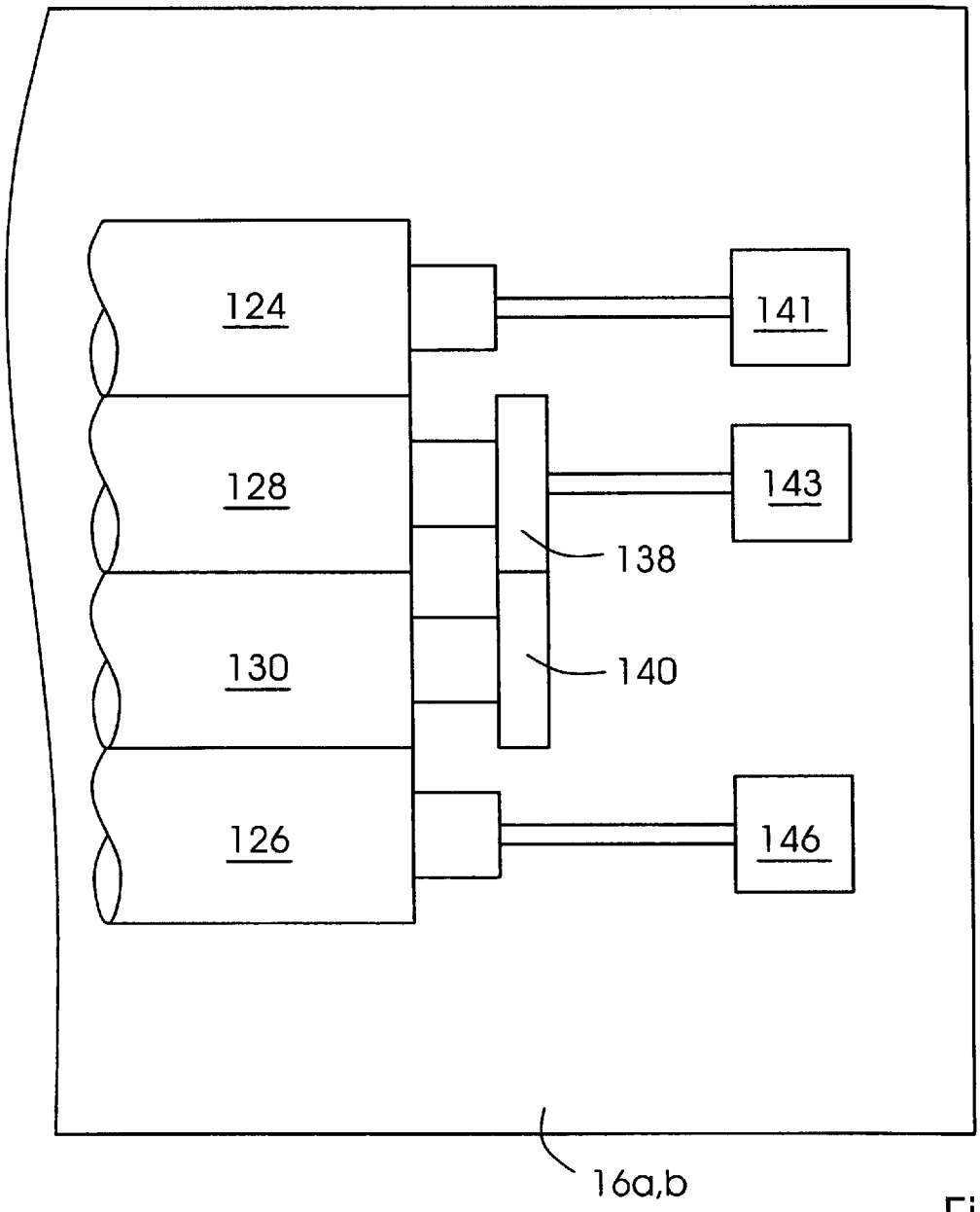
FIG. 3 is a schematic top view of an imprinter printing unit according to the present invention, in which the two blanket cylinders are coupled via meshing gear wheels and driven by a first drive motor, and each of the associated plate cylinders is individually driven by an associated own drive motor.
Figure 4:
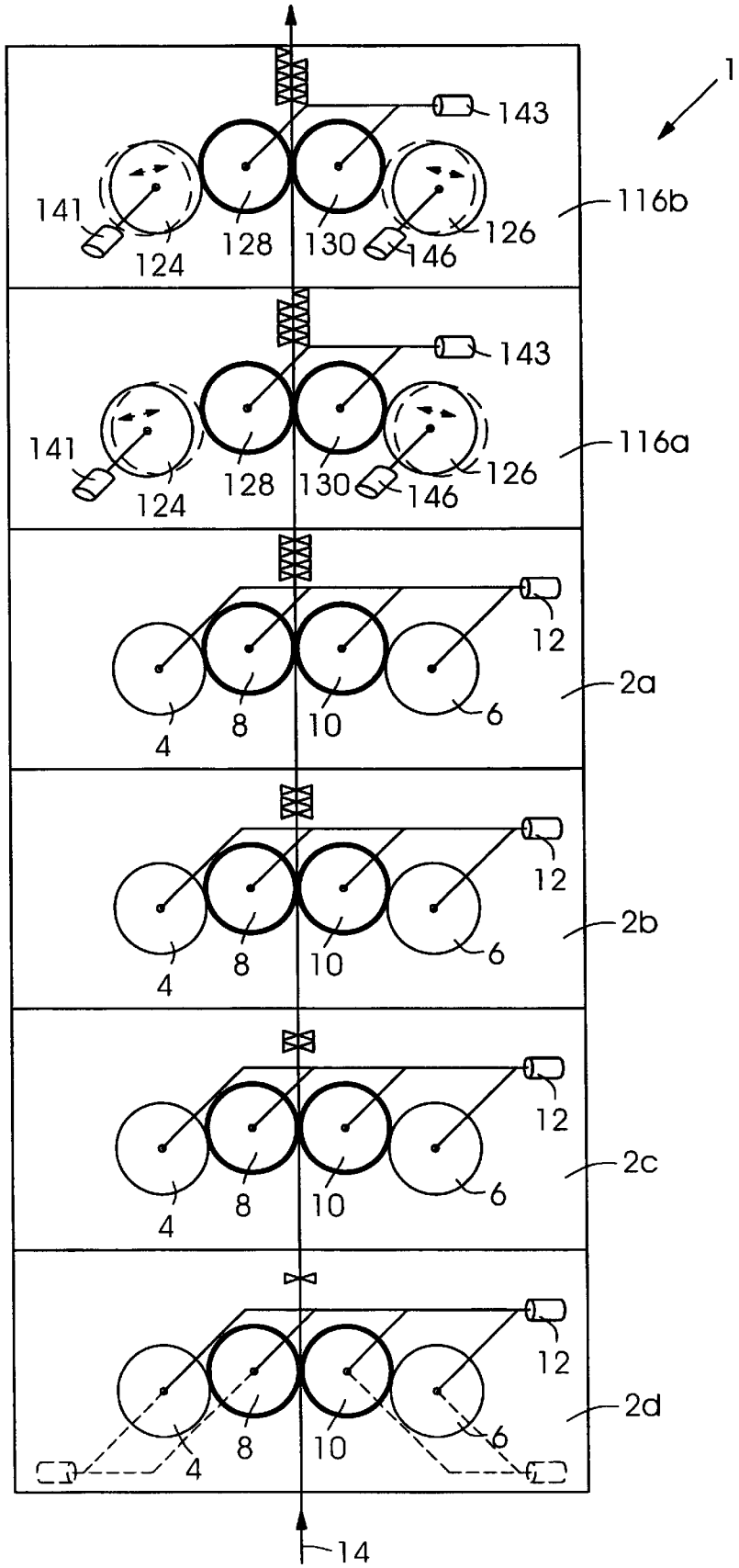
FIG. 4 is a schematic side view of a tower arrangement according to the present invention, in which two printing units of the type shown in FIG. 3 are located above printing units in which all cylinders are driven by only one common drive motor, in order to perform a flying imprinter operation on both sides of the running paper web.

According to another embodiment of the invention, which is shown in more detail in FIGS. 3 and 4, the second and third printing units 16*a*, 16*b* are formed by imprinter printing units 116*a* and 116*b* in which all together three drive motors are used for driving the plate and blanket cylinders of each unit.

As it is shown in FIG. 3, the second and third printing units 116*a*, 116*b* include a first and a second plate cylinder 124 and 126 and an associated first and second blanket cylinder 128 and 130. The first and second plate cylinders 124, 126 are each individually driven by an associated first and second drive motor 141, 146, respectively. The first and second drive motors 141, 146 may be directly driving into the drive shafts of the first plate cylinder 124 and second plate cylinder 126, respectively, or may be driving the cylinders 124, 126 via drive gear wheels or timing belts or gear boxes (not shown).

The first blanket cylinder 128 and the second blanket cylinder 130 are mechanically coupled via meshing gear wheels 138, 140 and are commonly driven by a third drive motor 143, which may drive either directly into one of the drive shafts of the cylinders 128, 130 or may drive into the drive gear wheels 138, 140, e.g. via a further gear wheel or a timing belt or a gear box (not shown).

As it is further indicated by the dashed lines and the full lines associated with the first and second plate cylinders 124, 126 of the printing units 116*a*, 116*b*, each of the first and second plate cylinders 124, 126 may be engaged and disengaged with its associated blanket cylinder 128, 130, while the web 14 is passing through the nip formed between the two blanket cylinders 128, 130 when the printing press is in operation, in order to provide for a flying imprinter operation on both sides of the running web 14. As it is further indicated by the position of the dashed lines and full lines of the first and second plate cylinders 124, 126 in FIG. 4, the corresponding plate cylinders which are located on the same side of the web 14, i.e. the first plate cylinders 124 of the lower and the upper printing units 116*a*, 116*b* are engaged and disengaged with their associated blanket cylinders 128 in alternation, in order to provide for on the run edition changes or changes of the spot color to be printed onto the web, while the web is passing through the nip formed between the two blanket cylinders 128, 130 of each of the printing units 2*a* to 2*d*, 116*a* and 116*b*.

For performing a flying edition change, the first plate cylinder 124 of the lower printing unit 116*a* may be disengaged from its associated blanket cylinder 128 while the printing press is in operation, may be slowed down to a stop by controlling the associated first drive motor 141, respectively, and may then be equipped with new printing plates for another edition and may afterwards be reaccelerated up to press speed to be reengaged with its associated first blanket cylinder 128 again.

The same may apply to the second blanket cylinders 126 of the printing unit 116*a*, 116*b* for performing an image change on the other side of the web 14, while the press is in operation.

Due to the combination of the single drive printing units 2*a* to 2*d* and the 3-motor drive printing units 116*a*, 116*b*, a printing unit arrangement 1 is obtained, which employs a reduced number of drive motors 12, 141, 143, 146, while it is at the same time highly flexible with respect to edition changes and spot color changes.

Moreover, it is also conceivable that instead of using printing units 2*a* to 2*d* in which all of the cylinders 4, 6, 8 and 10 are mechanically coupled via meshing gear wheels and are commonly driven by a single drive motor 12, each of the cylinder couples 4, 8, and 6, 10 may be individually driven by its own individual drive motor (not shown), which may either drive into the drive gear wheels of each plate cylinder 4, 6 of each couple, respectively, or, in order to obtain a more advantageous drive dynamics may drive into each of the drive gear wheels of the blanket cylinders 8, 10, respectively. In this embodiment, which provides for an easier set up and registration of the entire press in case of a plurality of printing units, the two blanket cylinders 8 and 10 are not coupled via meshing gear wheels, in order to provide for an independent registration of each print couple 4, 8 and 6, 10 by its associated drive motor, respectively. This embodiment is indicated by the dashed lines shown in printing unit 2*d* in FIG. 4.

What is claimed is:

1. Printing unit arrangement in a web-fed rotary printing press comprising:

a first printing unit, said first printing unit including a first and a second plate cylinder and a first and a second blanket cylinder, said first and second blanket cylinders and first and second plate cylinders being mechanically coupled to each other and being commonly driven by a common drive motor;

a second printing unit, said second printing unit including a first plate cylinder, a first blanket cylinder associated with said first plate cylinder, a second plate cylinder, a second blanket cylinder associated with said second plate cylinder, said second blanket cylinder being mechanically coupled to said first blanket cylinder, a first drive motor for individually driving said first plate cylinder, a second drive motor for individually driving said second plate cylinder and a third drive motor for driving said first and second blanket cylinders, said first and second printing units printing a coloured image on both sides of a paper web.

2. Printing unit arrangement of claim 1 further comprising:

third printing unit, said third printing unit including a first plate cylinder, a first blanket cylinder associated with said first plate cylinder, a second plate cylinder, a second blanket cylinder associated with said second plate cylinder, said second blanket cylinder being mechanically coupled to said first blanket cylinder, a first drive motor for individually driving said first plate cylinder, a second drive motor for individually driving said second plate cylinder and a third drive motor for driving said first and second blanket cylinders.

3. Printing unit arrangement of claim 2, wherein said first plate cylinder of said second printing unit and said first plate cylinder of said third printing unit are engageable and disengageable with their associated blanket cylinders in alternation, to alternatingly print different images on a first side of paper web, while the printing press is in operation.

4. Printing unit arrangement of claim 3, wherein said second plate cylinder of said second printing unit and said second plate cylinder of said third printing unit are engagable and disengagable with their associated blanket cylinders in alternation, to alternatingly print different images on a second side of the paper web, while the printing press is in operation.

5. Printing unit arrangement of claim 1, further comprising one or more blanket-to-blanket printing units for printing coloured images on a first and a second side of a running paper web.

6. Printing unit arrangement of claim 5, wherein each blanket-to-blanket printing unit includes a first and a second plate cylinder and a first and a second blanket cylinder, said first and second blanket cylinders and first and second plate cylinders being mechanically coupled to each other and being commonly driven by a common drive motor.

7. Printing unit arrangement of claim 1, wherein said first printing unit and said second printing unit are arranged one above other with the web running in a substantially vertical direction.

* * * * *

UNITED STATES PATENT AND TRADEMARK OFFICE

CERTIFICATE OF CORRECTION

PATENT NO. : 6,345,574 B1
DATED : February 12, 2002
INVENTOR(S) : Charette et al.

It is certified that error appears in the above-identified patent and that said Letters Patent is hereby corrected as shown below:

Title page,
Item [73], "Heidelberger, Druckmaschinen AG, Heidelberg (DE)" should read -- Heidelberger Druckmaschinen AG, Heidelberg (DE) --.

Signed and Sealed this

Twentieth Day of August, 2002

*Attest:*

*Attesting Officer*

JAMES E. ROGAN
*Director of the United States Patent and Trademark Office*